US010183406B2

(12) United States Patent
Karchon et al.

(10) Patent No.: US 10,183,406 B2
(45) Date of Patent: Jan. 22, 2019

(54) THUMB STUD INCLUDING TRITIUM

(71) Applicant: Cammenga Company, LLC, Dearborn, MI (US)

(72) Inventors: Christopher J. Karchon, Bloomfield Hills, MI (US); Alexander J. Karchon, Birmingham, MI (US)

(73) Assignee: Cammenga Company, LLC, Dearborn, MI (US)

( * ) Notice: Subject to any disclaimer, the term of this patent is extended or adjusted under 35 U.S.C. 154(b) by 0 days.

(21) Appl. No.: 15/443,210

(22) Filed: Feb. 27, 2017

(65) Prior Publication Data

US 2017/0246749 A1 Aug. 31, 2017

Related U.S. Application Data

(60) Provisional application No. 62/300,113, filed on Feb. 26, 2016.

(51) Int. Cl.

| | |
|---|---|
| ***B26B 11/00*** | (2006.01) |
| ***B26B 1/04*** | (2006.01) |
| ***B26B 1/10*** | (2006.01) |
| ***F21K 2/00*** | (2006.01) |

(52) U.S. Cl.

CPC ..... *B26B 11/00* (2013.01); *B26B 1/048* (2013.01); *B26B 1/10* (2013.01); *F21K 2/00* (2013.01)

(58) Field of Classification Search

CPC . B26B 11/008; F21V 33/0036; F21V 33/0084
See application file for complete search history.

(56) References Cited

PUBLICATIONS

Screenshot of YouTube.com (https://www.youtube.com/watch?v=soJd1CPDRwY), published Oct. 11, 2014.*
Screenshot of web page for Monroe Knives, (https://web.archive.org/web/20140617160014/http://www.munroeknives.com/gallery/archon.html), published Jun. 2014.*

* cited by examiner

*Primary Examiner* — Andrew Coughlin
(74) *Attorney, Agent, or Firm* — Dickinson Wright PLLC

(57) ABSTRACT

A thumb stud for a folding knife assembly includes a body extending between a first end and a second end. A hollow passage extends between the ends, and a tritium vial is disposed within the hollow passage and extends between the first and second ends. A first lens is disposed within the hollow passage adjacent the first end and a second lens is disposed within the hollow passage adjacent the second end. The first and second lenses encapsulate the tritium vial within the hollow passage of the body and allow illumination produced by the tritium vial to be viewable through the first and second lenses to illuminate the thumb stud. In an alternative arrangement, the tritium vial can be replaced with a wafer which houses the tritium vial. In this arrangement, a pair of wafers are each disposed adjacent respective lenses at respective ends of the body.

19 Claims, 6 Drawing Sheets

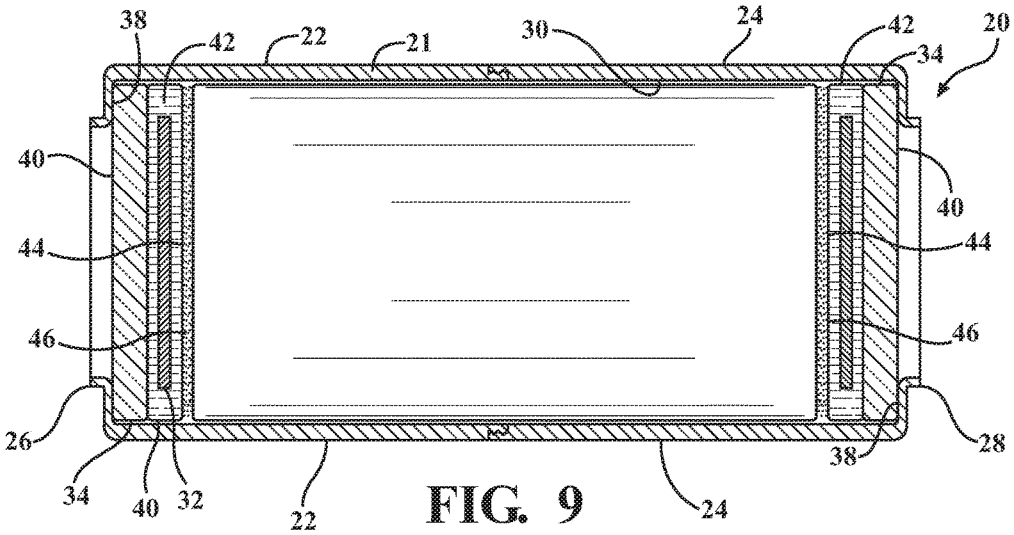
FIG. 9
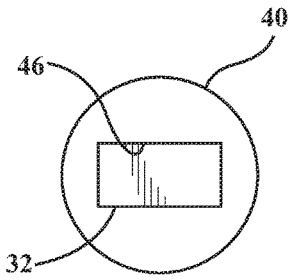
FIG. 10A
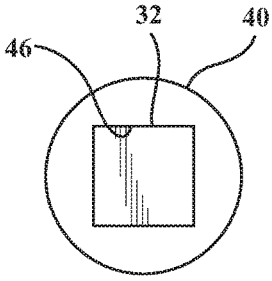
FIG. 10B
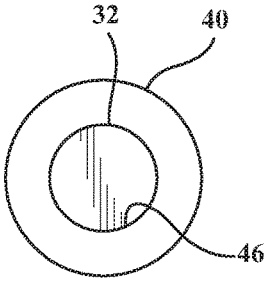
FIG. 10C
FIG. 11
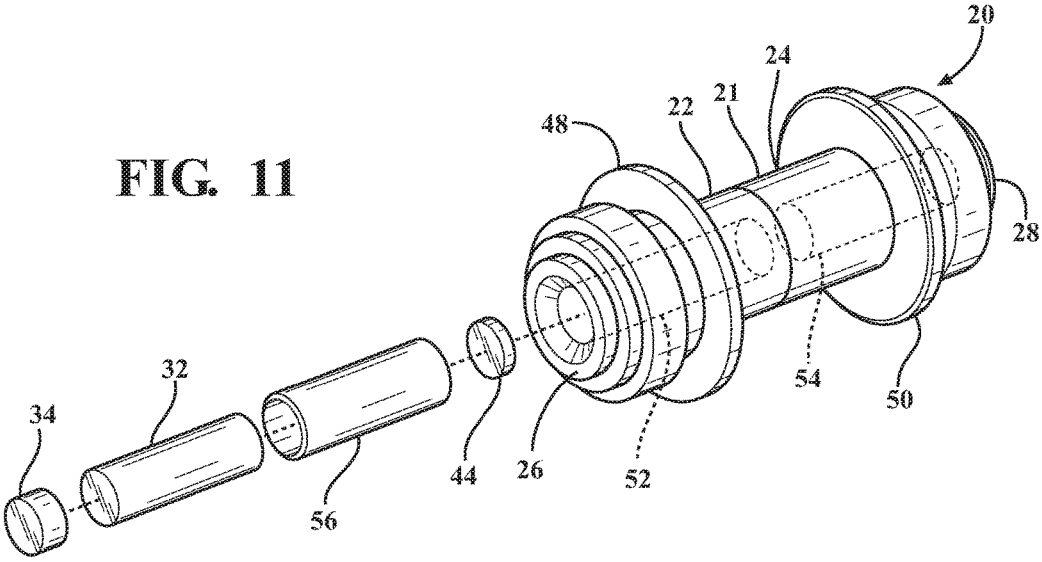

THUMB STUD INCLUDING TRITIUM

CROSS-REFERENCE TO PRIOR APPLICATION

This non-provisional patent application claims the benefit of U.S. Provisional Patent Application Ser. No. 62/300,113 filed Feb. 26, 2016, the entire disclosure of the application being considered part of the disclosure of this application and hereby incorporated by reference.

BACKGROUND OF THE INVENTION

1. Field of the Invention

The present disclosure relates generally to a thumb stud for a folding knife assembly. More specifically, the present disclosure relates to a thumb stud which includes or incorporates tritium.

The present disclosure also relates generally to a folding knife assembly which includes a thumb stud that incorporates tritium.

2. Description of the Prior Art

This section provides a general summary of background information and the comments and examples provided in this section are not necessarily prior art to the present disclosure.

Tritium is a radioactive isotope of hydrogen which can be used as a luminary device for watches, compasses, knives, guns, tools, and the like. Naturally occurring tritium is extremely rare and thus too small for practical recovery. Accordingly, tritium is typically only produced in nuclear reactors and provided or retained within glass vials. However, the use of tritium in products, such as watches, compasses, knives, guns, tools, and the like, is closely regulated by various U.S. governmental organizations to protect the health and safety of the public and the environment. Toward that end, the use and incorporation of the tritium glass vials into said products is closely regulated by the federal government and any such use must sufficiently establish that the tritium vials are adequately protected from damage or breakage during their regular and everyday use. Absent such proof, the use and incorporation of tritium glass vials into said products is simply not permitted by the various U.S. governmental organizations.

Thus, there remains a significant and continuing need for aspects of incorporating tritium vials into thumb studs of knife assemblies which are intended to meet these strict federal government regulations while correspondingly providing the aesthetic and luminary benefits which stem from the use of tritium in the knife assembly.

SUMMARY OF THE INVENTION

According to an aspect, the subject invention is directed to a thumb stud for a knife assembly which includes a body extending between a first end and a second end. The body defines a hollow passage extending between the first and second ends, and a vial of tritium is disposed with the hollow passage and extends between the first and second ends. A first lens is disposed within the hollow passage adjacent the first end and a second lens is disposed within the hollow passage adjacent the second end to encapsulate the tritium vial within the hollow passage of the body. The first and second lenses protect the tritium vial and also allow illumination produced by the tritium vial to be viewable through the first and second lenses to effectively illuminate the thumb stud.

According to another aspect, the subject invention is directed to a thumb stud for a knife assembly which includes a body extending between a first end and a second end and which defines a hollow passage extending between the ends. A first lens is disposed within the hollow passage adjacent the first end and a second lens is disposed within the hollow passage adjacent the second end. A first wafer which encapsulates a first vial of tritium is disposed within the hollow passage adjacent the first lens. A second wafer which encapsulates a second vial of tritium is also disposed within the hollow passage adjacent the second lens. A bonding material is disposed within the hollow passage and in contact with the first and second wafers to sandwich the first and second wafers between the respective lenses and the bonding material and also secure the first and second wafers adjacent the respective first and second ends of the body. Similar to the first embodiment, the lens and bonding material protect the tritium vials disposed within the wafers and also allow illumination produced by the tritium vial to be viewable through the first and second lenses to effectively illuminate the thumb stud.

According to another aspect, the subject invention is directed to a thumb stud for a knife assembly which includes a body extending between a first end and a second end. The body has a first portion and a second portion threadingly interconnected with one another, with the first portion defining a first hollow passage extending from the first end and the second portion defining a second hollow passage extending from the second end. A first tritium vial is disposed within the first hollow passage and a second tritium vial is disposed within the second hollow passage. A first lens is disposed within the first hollow passage and adjacent the first end to encapsulate and protect the first vial of tritium within the first hollow passage of the first portion of the body and allow illumination produced by the first tritium vial to be viewable through the first lens to illuminate the first end of the thumb stud. A second lens is disposed within the second hollow passage and adjacent the second end to encapsulate and protect the second vial of tritium within the second hollow passage of the second portion of the body and allow illumination produced by the second tritium vial to be viewable through the second lens to illuminate the second end of the thumb stud.

BRIEF DESCRIPTION OF THE DRAWINGS

The drawings described herein are for illustrative purposes only of selected embodiments and not all possible implementations, and are not intended to limit the scope of the present disclosure.

FIG. 9 is a cross-sectional view of a second embodiment of a thumb stud illustrating a pair of wafers encapsulating a tritium vial and each disposed adjacent respective first and second ends of the body in sandwiched relationship between a lens and a bonding material;

FIG. 10A is a top view of a first arrangement of the wafer illustrating a rectangular shaped cavity for housing the tritium vial;

FIG. 10B is a top view of a second arrangement of the wafer illustrating a square shaped cavity for housing the tritium vial;

FIG. 10C is a top view of a third arrangement of the wafer illustrating a circular shaped cavity for housing the tritium vial;

FIG. 11 is an exploded, perspective view of a third embodiment of the thumb stud;

DETAILED DESCRIPTION OF THE ENABLING EMBODIMENTS

Example embodiments of a thumb stud which includes or incorporates tritium in accordance with the present disclosure will now be more fully described. Each of these example embodiments are provided so that this disclosure is thorough and fully conveys the scope of the inventive concepts, features and advantages to those skilled in the art. To this end, numerous specific details are set forth such as examples of specific components, devices and mechanisms associated with the thumb stud to provide a thorough understanding of each of the embodiments associated with the present disclosure. However, as will be apparent to those skilled in the art, not all specific details described herein need to be employed, the example embodiments may be embodied in many different forms, and thus should not be construed or interpreted to limit the scope of the disclosure. For example, although the subject disclosure is focused on various aspects of incorporating tritium into thumb studs of knifes, one of skill in the art would readily appreciate that the details described herein can be employed in a wide range of other applications, such as buttons or switches, or other devices, such as within a side handle of a knife blade assembly, other bladed products, and any other tools which would benefit from tritium illumination such as a Leatherman®, hammer, screwdriver, and/or shovel as non-limiting examples.

Figure 1:
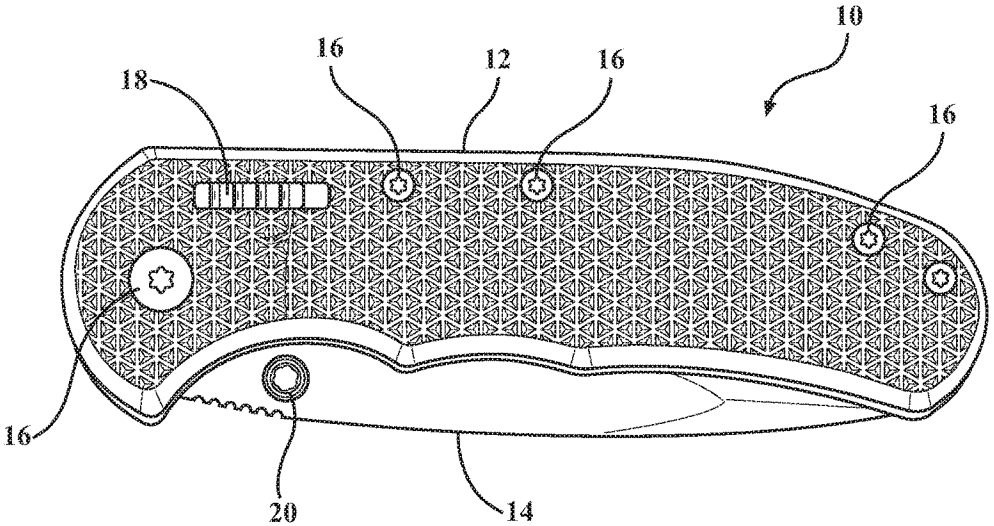
FIG. 1 is a perspective view of a folding knife assembly illustrating a knife blade disposed in a closed position and including a thumb stud.
Figure 2:
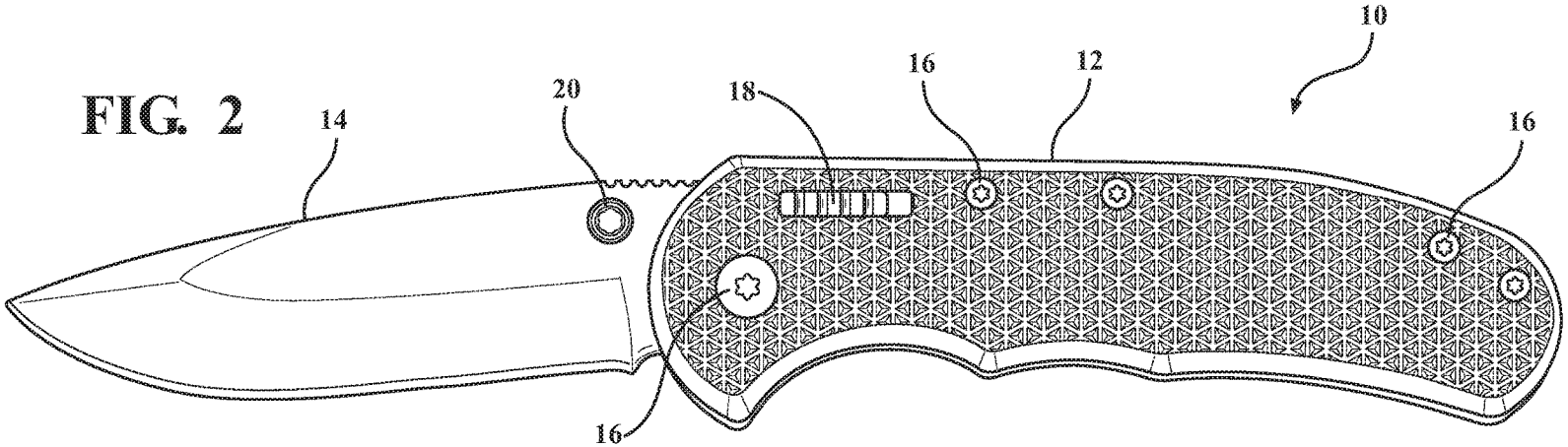
FIG. 2 is a perspective view of the folding knife assembly illustrating the knife blade disposed in an engaged or open position.

FIG. 1 is a perspective view of a folding knife assembly 10 in accordance with an aspect of the subject disclosure. As best shown therein, the knife assembly 10 includes a handle 12 which may be any size, shape, or configuration for providing a gripping portion of the knife assembly 10. A knife blade 14 is pivotably connected to the handle 12 and pivotable from a closed position, as illustrated in FIG. 1, to an engaged or open position, as illustrated in FIG. 2. As will be appreciated by one of skill in the art, the knife blade 14 is shorter than the length of the handle 12 so that the blade 14 may be folded and be secured partially and/or fully within the handle 12, as illustrated in FIG. 2.

As best illustrated in FIGS. 1 and 2, preferably one or more fasteners 16 hold the knife blade 14 and the handle 12 together. The fastener may be any fastener that may form a removable connection, a fixed connection, or both. The fastener may be an adhesive, a mechanical fastener, a screw, a bolt, a nut, a rivet, a nail, a mechanical interlock, the like, or any combination thereof. The folding knife assembly 10 also includes a button, switch, or pull 18 to release the knife blade 12 from the engaged or open position illustrated in FIG. 2. The button, switch, or pull 18 is attached to the folding knife assembly 10 with a fastener (not expressly shown). The fastener may be any fastener discussed herein.

Figure 3:
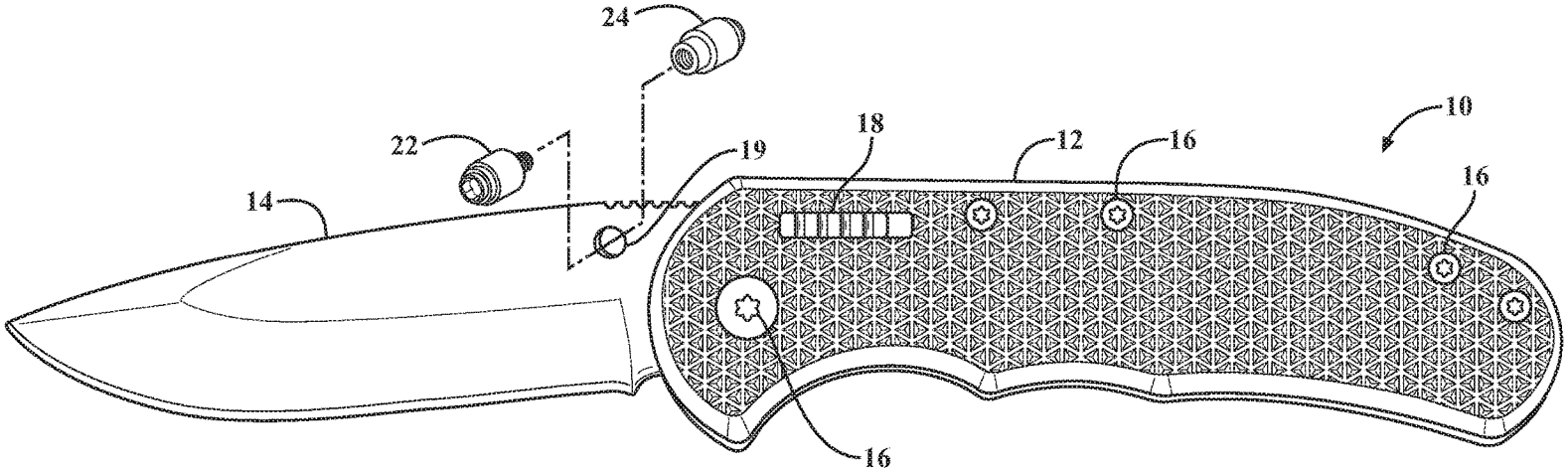
FIG. 3 is a perspective view of the folding knife assembly in the engaged or open position and illustrating an aperture extending through the knife blade for receiving the thumb stud.
Figure 5:
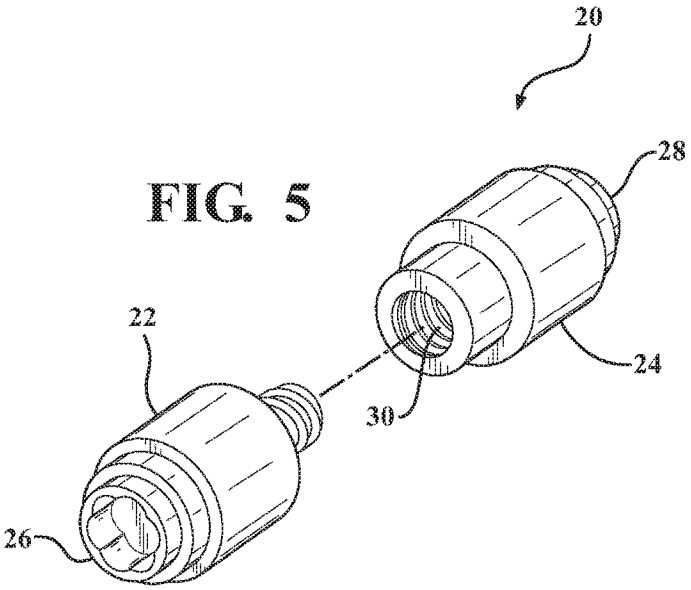
FIG. 5 is a perspective view of the first portion and the second portion of the body threadingly disengaged from one another to illustrate a hollow passage extending through the first and second portions.
Figure 4:
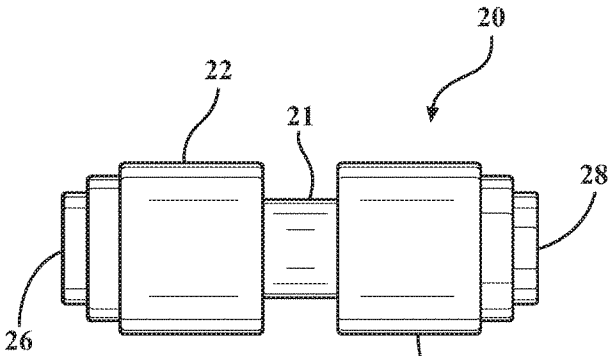
FIG. 4 is a perspective view of a body of the thumb stud extending from a first end to a second end and having first portion and a second portion threadingly engaged with one another.

As best illustrated in FIG. 3, the knife blade 14 defines an aperture 19 extending therethrough from a first side to a second side of the knife blade 14. As best illustrated in FIGS. 1 and 2, the folding knife assembly 10 includes a thumb or lock stud 20 which extends through the aperture 19 of the knife blade 14 for allowing a user to quickly and easily pivot the knife blade 14 from the closed position to the engaged or open position using their thumbs. According to an aspect of the subject disclosure, and as best illustrated in FIGS. 3-5, the thumb stud 20 includes a body 21 having a first portion 22 and a second portion 24 which are threadingly connected to one another. As best illustrated in FIG. 4, when the first and second portions 22, 24 are threadingly connected to one another, the thumb stud 20 extends from a first end 26 to a second end 28, with the first end 26 to be disposed on the first side of the knife blade 14 and the second end 28 to be disposed on the opposing second side of the knife blade 14.

Figure 6:
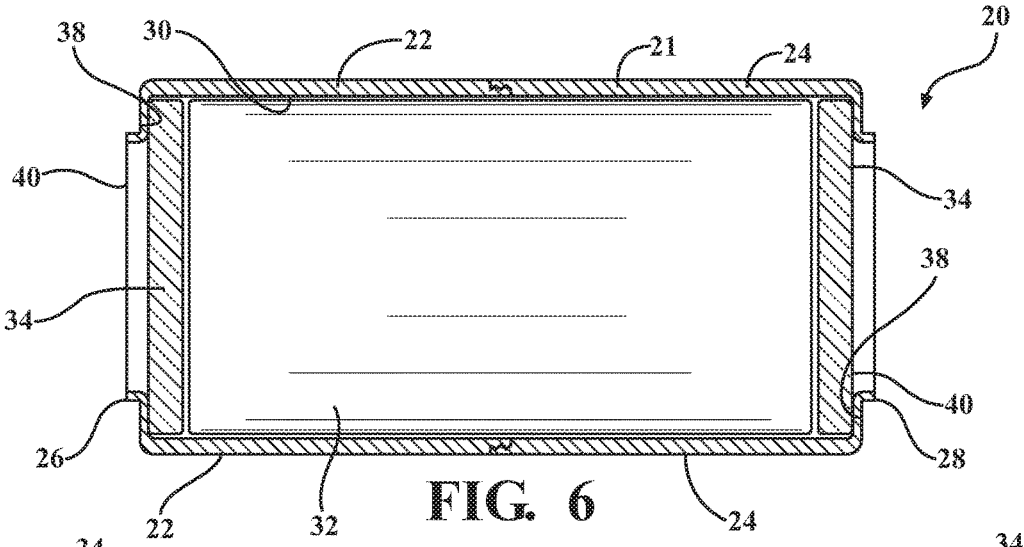
FIG. 6 is a cross-sectional view of a first embodiment of the thumb stud including a tritium vial extending within the hollow passage of the first and second portions between the first and second ends of the body, and a first lens and a second lens disposed adjacent respective ends of the body to encapsulate the tritium vial within the body.

As best illustrated in FIG. 6, according to a first aspect of the subject disclosure, the body 21 of the thumb stud 20 defines a hollow passage 30 extending through the first and second portions 22, 24 from the first end 26 to the second end 28, and a tritium vial 32 preferably of cylindrical shape is disposed within the hollow passage 30 between the ends 26, 28. A first and second lens 34 comprised of transparent or translucent material, such as glass or an injection molded plastic, are each disposed within the hollow passage 30 and adjacent respective first or second ends 26, 28 of the first and second thumb stud portions 22, 24 to encapsulate the tritium vials 32 within the hollow passage 30. As previously mentioned, the cylindrical tritium vial 32 is often a glass vial and thus susceptible to damage and/or breakage. The disposal of the tritium vial 32 within the hollow passage 30 and protected by the first and second lenses 34 also allows the thumb stud 20 to provide protection from such damage and/or breakage. Put another way, the body 21 of the thumb stud 20 nests the tritium vial 32 within its hollow passage 30 to effectively isolate or reduce exposure of the tritium vials 32 to various environmental impacts encountered by the knife assembly 10. Furthermore, placement of the first and second lens 34 about the first and second ends 26, 28 of the first and second thumb stud portions 22, 24 further serves to protect the tritium vials 32 from impact, chemicals, water, or other environmental conditions of the knife blade assembly 10 which could otherwise damage, break, or compromise the integrity of the tritium vial 32.

As will be appreciated from the subject disclosure, the incorporation of the tritium vials 32 into the thumb stud 20 provides aesthetic benefits to the knife blade assembly 20 by illuminating the thumb stud 20 and allowing a user to see the thumb stud 20 at all times. Not only does the lens 34 protect the tritium vial 32, but its transparent or translucent composition allows illumination produced by the tritium vial 32 to be viewable by the user from out of the hollow passage 30 and through the lens 34.

According to an aspect, and as best illustrated in FIGS. 7A-7B and 8A-8C, the lens 34 can include an outwardly extending flange portion 36. Furthermore, each of the first and second portions 22, 24 of the body 21 can define a corresponding shoulder 38 for receiving the flange portions 36. Put another way, when the first and second portions 22, 24 of the body 21 are threadingly connected to establish an assembled condition of the thumb stud 20, the flange portion 36 of the lenses 34 are disposed in abutting or nesting relationship with the shoulder 38 defined by the first and second ends 26, 28 of the first and second portions 22, 24 of the thumb stud body 21. As will be described in more detail below, this abutting relationship between the flange 36 and shoulder 38 advantageously secures or maintains the tritium vial 32 within the hollow portion 30 and between the first and second ends 26, 28 of the thumb stud 20. As best illustrated in FIG. 6, if the lens 34 does not include a flange portion but rather is simply comprised of a disk or circular shape, a flat surface 40 of the lens 34 is disposed in abutting relationship with the shoulder 38 for securing or maintaining the tritium vial 32 within the hollow portion 30 of the thumb stud 20.

Figure 7A:
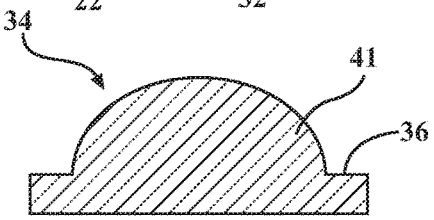
FIG. 7A is a cross-sectional view of the lens illustrating an outwardly extending flange portion and a first arrangement of a geometrically shaped portion.
Figure 7B:
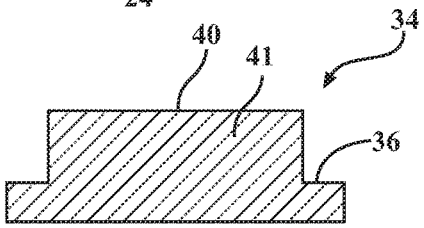
FIG. 7B is a cross-sectional view of the lens illustrating the outwardly extending flange portion and a second arrangement of the geometrically shaped portion.
Figure 8A:
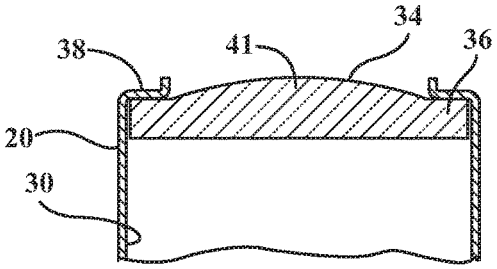
FIG. 8A is a fragmentary, cross-sectional view of a portion of the thumb stud illustrating the outwardly extending flange portion disposed in abutting relationship with a shoulder defined by a respective end of the body and the geometrically shaped portion disposed flush with the respective end of the body.
Figure 8B:
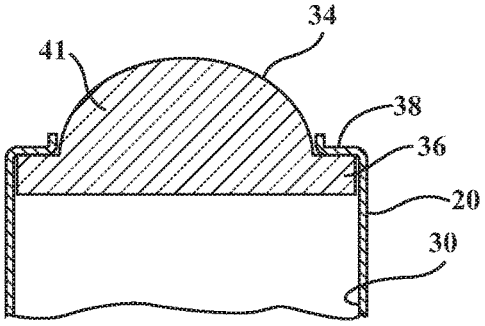
FIG. 8B is a fragmentary, cross-sectional view of a portion of the thumb stud illustrating the geometrically shaped portion projecting outwardly from the respective end of the body.
Figure 8C:
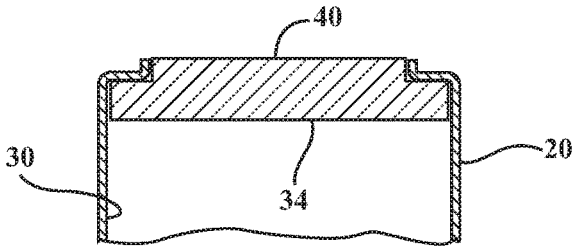
FIG. 8C is a fragmentary, cross-sectional view of a portion of the thumb stud illustrating another arrangement of the geometrically shaped portion disposed flush with the respective end of the body.

According to an aspect, and as illustrated in FIGS. 7A-7B and 8A-8C, the first and second lenses 34 can each also preferably include a geometrically shaped portion 41 to magnify, amplify, or extend the visibility of the tritium illumination. For example, as best illustrated in FIG. 7A, the geometrically shaped portion 41 of the lens 34 can have a domed or curved shape so that the tritium illumination is viewable by a user from a wider range of angles relative to the knife assembly 10 and the thumb stud 20. However, as best illustrated in FIGS. 7B and 8C, the geometrically shaped portion 41 can also have a rectangular shaped body to define a flat viewing surface 40. As illustrated in FIGS. 8A and 8C, in an arrangement the geometrically shaped portion 41 is disposed flush with the first and second ends 26, 28 of the thumb stud 20. However, as illustrated in FIG. 8B, in an alternative arrangement the geometrically shaped portion 41 of the lens 34 is disposed such that it projects out of the first and second ends 26, 28 of the thumb stud 20 to be viewable by a user from multiple sides or angles of the knife blade assembly 20.

As previously described, and as illustrated in FIGS. 3-5, the first and second portions 22, 24 of the thumb stud 20 are threadingly connected to one another and each define a hollow passage 30 of the thumb stud 20. Accordingly, the following describes a method of incorporating the tritium vial 32 into the thumb stud 20. Prior to threadingly interconnecting the first and second portions 22, 24 to one another, and assembling the thumb stud 20 through the aperture 19 of the knife blade 14, each of the lenses 34 are placed within the hollow passage 30 that extends through the first or second portions 22, 24 and moved into abutting relationship with the shoulders 38. The tritium vial 32 is then placed within the hollow passage 30 extending through one of the respective first or second portion 22, 24 which is then placed through an aperture 19 defined in the knife blade 14. Once the first or second portion 22, 24 and the tritium vial 32 passes or extends through the aperture 19, the other one of the first or second portion 22, 24 is threadingly connected to the other portion 22, 24 to secure the thumb stud 22, with the tritium vial 32, included or incorporated therein, to the knife blade 14. The connection of the first portion 22 to the second portion 24 also secures or maintains the cylindrical vial of tritium 32 within the hollow passage 30 between the two lenses 34.

A second embodiment of a thumb stud 20 including tritium is illustrated in FIG. 9, in which like numerals are utilized to label like elements described in the aforementioned first embodiment. Similar to the first embodiment, the body 21 of the thumb stud 20 defines a hollow passage 30 which extends within the first and second portions 22, 24 from the first end 26 to the second end 28. However, in the second embodiment, a pair of tritium vials 32 are each encapsulated within a wafer or tray 40, preferably comprised of glass or plastic translucent material, that is disposed within the hollow passage 30 next adjacent each of the first or second ends 26, 28 of the first or second thumb stud portions 22, 24. In other words, the pair of wafers 40 encapsulating the tritium vial 32 do not extend the entire length of the thumb stud 20 but rather are just disposed next to the open first and second ends 26, 28 of the thumb stud 20. As best illustrated in FIGS. 10A-10C, each of the wafers 40 defines a cavity 46 and the tritium vials 32 are housed within the cavities 46 for providing further protection of the tritium vials 32 from an environment of the thumb stud 20.

According to an aspect, and as further illustrated in FIGS. 10A-10C, various shapes of the cavities 46 can be utilized to support and protect various shapes of the tritium vials 32. For example, each of the cavities 46 and corresponding tritium vials 32 could be rectangular, square, circular, or the like. In this second embodiment, the use of wafers 42 which encapsulate tritium vials 32 advantageously utilizes less tritium to illuminate the thumb stud 20, which can provide reduced manufacturing and product costs for a thumb stud 20 illuminated by tritium.

As best illustrated in FIG. 9, and similar to the first embodiment, a first and second lens 34 comprised of transparent or translucent material, such as glass or an injection molded plastic, is disposed adjacent respective first or second ends 26, 28 of the first and second portions 22, 24. However, in the second embodiment, each wafer 42 which encapsulates the tritium vial 32 is sandwiched between a respective lens 34 and a bonding material 44, such as glue, sealant, or any other suitable material or mechanical means, for maintaining the pair of wafers 42 next adjacent respective ends 26, 28 of the thumb stud 20. As previously mentioned, the tritium vials 32 are susceptible to damage and/or breakage. Accordingly, in this second aspect, the encapsulation of the tritium vials 32 within the wafer 42 which is then sandwiched or maintained between a lens 34 and bonding material 44 could offer additional protection from damage or breakage, such as through the cushioning of the wafers 40 by way of the pliable bonding material 44, which are not provided in other aspects of implementing tritium in a thumb stud 20. Furthermore, similar to the first embodiment, placement of the first and second lens 34 about the first and second ends 26, 28 of the first and second thumb stud portions 22, 24 encapsulates the wafers 42 within the hollow passage 30 and further serves to protect the tritium vials 32 from impact, chemicals, water, or other environmental conditions of the knife blade assembly 20 which could otherwise damage or break the wafers 42 and/or the tritium vials 32 nested or housed therein.

As will be appreciated from the subject disclosure, the incorporation of the wafers 42 into the thumb stud 20 provides aesthetic benefits to the knife blade assembly 20 by illuminating the thumb stud 20 and allowing a user to see the thumb stud 20 at all times. Not only does the lens 34 protect the wafers 42 which encapsulate the tritium vial 32, but its transparent or translucent composition allows illumination produced by the tritium vials 32 to be viewable by the user. Although not expressly illustrated, the shaped variations of the lenses 34 illustrated in FIGS. 7A-7B and 8A-8C of the first embodiment could be implemented in place of the disc or circular shaped lens 34 of FIG. 9 without departing from the scope of the subject disclosure. Such a replacement of the disc or circular shaped lens 34 of FIG. 9 would provide the same illumination and visibility benefits and advantages as previously discussed in conjunction with the thumb stud 20 described in accordance with the first embodiment. Furthermore, according to an aspect, an outside surface 46 of the bonding material 42 which faces the first and second ends 26, 28 and is disposed in overlaying relationship with the wafers 42 can be coated with or comprised of a bright or shiny surface, such as white, mirrored, glassy, or the like, to further magnify illumination produced by the tritium vial 32 housed within the wafers 42.

As previously described, and as illustrated in FIGS. 3-5, the first and second portions 22, 24 of the thumb stud 20 are threadingly connected to one another and each define a hollow passage 30 of the thumb stud 20. Accordingly, the following describes the method of incorporating the wafers 42 which house the tritium vials 32 into the thumb stud 20. Prior to threadingly interconnecting the first and second portions 22, 24 to one another, and assembling the thumb stud 20 through the aperture 19 of the knife blade 14, each of the lenses 34 are placed within a respective first or second portion 22, 24 and moved into abutting relationship with the shoulders 38. The pair of wafers 42 are then inserted into a respective hollow passage 30 of the first or second portion 22, 24 and moved into abutting or adjacent relationship with the respective lenses 34. A bonding material 44 is then placed over the pair of wafers 42 to secure the wafers 42 within the hollow passage 30 and next adjacent the lenses 34. One of the first or section portions 22, 24 are then passed through the aperture 19 defined in the knife blade 14. Once the first or second portion 22, 24 passes or extends through the aperture 19, the other one of the first or second portion 22, 24 is threadingly connected to the other portion 22, 24 to secure the thumb stud 20, with the tritium vials 32 included or incorporated into the hollow passage 30 by way of the wafers 40, to the knife blade 14.

Figure 12:
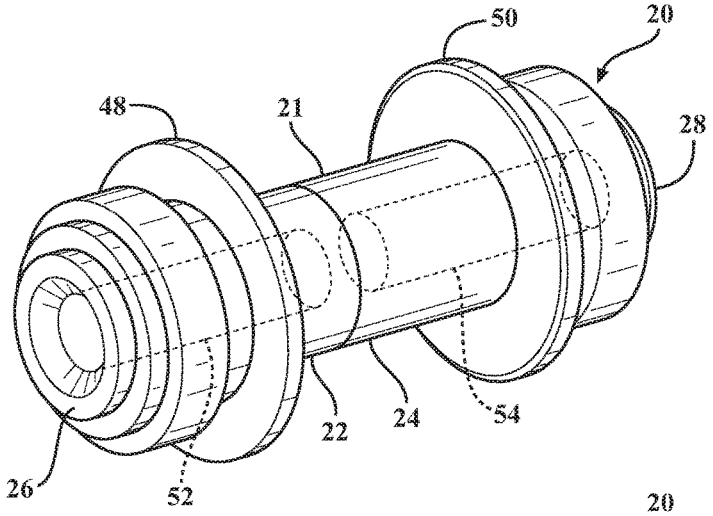
FIG. 12 is a perspective view of the third embodiment of the thumb stud illustrating the first portion of the body defining a first hollow passage extending from the first end and the second portion of the body defining a second hollow passage extending from the second end.
Figure 13:
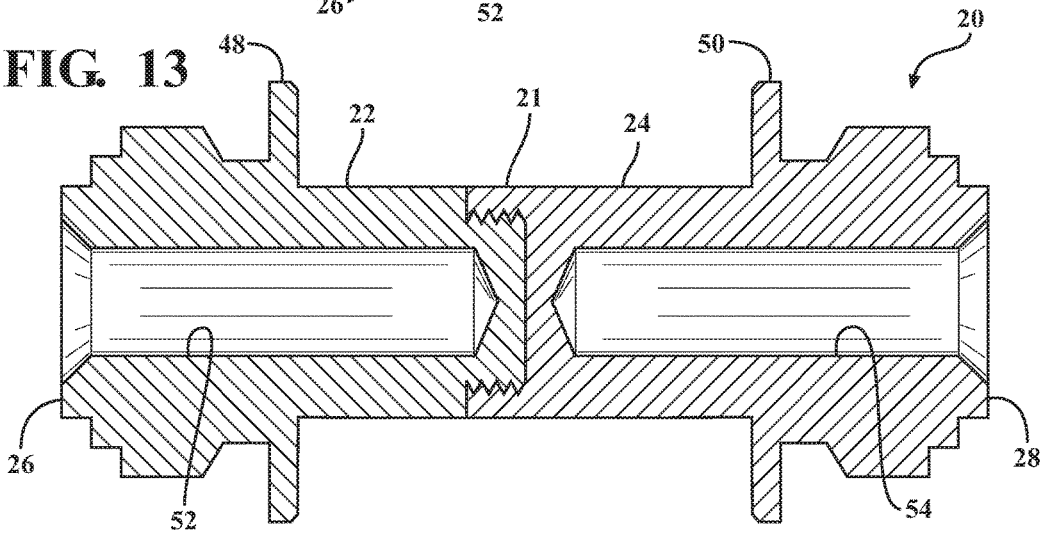
FIG. 13 is a cross-sectional view of the third embodiment of the thumb stud illustrating a first annular stop extending from the first portion of the body and a second annular stop extending from a second portion of the body.
Figure 14:
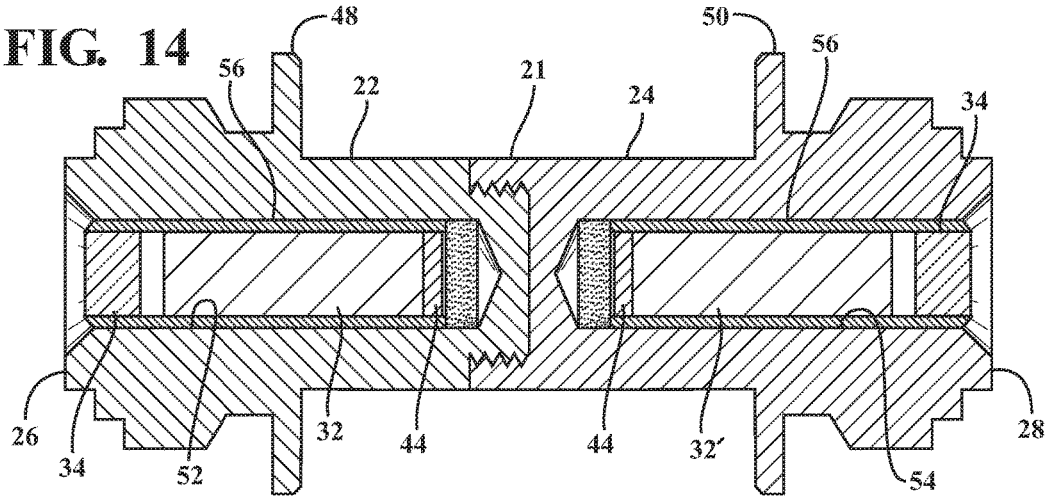
FIG. 14 is a cross-sectional view of the third embodiment of the thumb stud illustrating a tritium vial disposed in the first and second hollow passages in sandwiched relationship between a lens and a bonding material, and a protective sleeve disposed in surrounding relationship with the tritium vials to provide further protection and cushioning of the tritium vials within the first and second portions of the body.

A third embodiment of a thumb stud 20 including tritium is illustrated in FIGS. 11-14, in which like numerals are utilized to label like elements described in the aforementioned first and second embodiments. Similar to the first and second embodiments, the thumb stud 20 includes a body 21 having a first portion 22 and a second portion 24 which are threadingly connected to one another. As best illustrated in FIGS. 12-14, when the first and second portions 22, 24 are threadingly connected to one another, the thumb stud 20 extends from a first end 26 to a second end 28, with the first end 26 to be disposed on the first side of the knife blade 14 and the second end 28 to be disposed on the opposing second side of the knife blade 14. In this regard, the first portion 22 can include a first annular stop 48 extending radially outwardly from the body 21 for resting against the first side of the knife blade 14 when the thumb stud 20 is assembled to the knife blade assembly 10. Similarly, the second portion 24 can include a second annular stop 50 extending radially outwardly form the body 21 for resting against the second side of the knife blade when the thumb stud 20 is assembled to the knife blade assembly 10.

However, unlike the first and second embodiments, the body 21 does not define a hollow passage which extends continuously between the first and second ends 26, 28. Instead, the first portion 22 of the body 21 defines a first hollow passage 52 which extends from the first end 26 and the second portion 24 of the body defines a second hollow passage 54 which extends from the second end such that the first and second hollow passages 52, 54 do not interconnect, i.e., are not disposed in communication with one another, when the first and second portions 22, 24 of the body 21 are threadingly interconnected to one another. As best illustrated in FIG. 14, a first tritium vial 32 is disposed within the first hollow passage 52 and a second tritium vial 32' is disposed within the second hollow passage 54.

Similar to the first and second embodiments, a first and second lens 34 comprised of transparent or translucent material, such as glass or an injection molded plastic, is disposed adjacent respective first or second ends 26, 28 of the first and second portions 22, 24. Furthermore, similar to the second embodiment, each tritium vial 32 is sandwiched between a respective lens 34 and a bonding material 44, such as glue, adhesive, or the like, for maintaining the tritium vials 32 within their respective hollow passages 52, 54 and next adjacent respective ends 26, 28 of the thumb stud 20. As previously mentioned, the tritium vials 32, 32' are susceptible to damage and/or breakage. Accordingly, in this third aspect, the sandwiching of the tritium vials 32, 32' between a lens 34 and bonding material 44 offers additional protection from damage or breakage, such as through the cushioning of the tritium vials 32, 32' by way of the pliable bonding material 44, which are not provided in other aspects of implementing tritium in a thumb stud 20. Furthermore, placement of the first and second lens 34 about the first and second ends 26, 28 of the first and second thumb stud portions 22, 24 encapsulates the vials within their respective hollow passages 52, 54 and further serves to protect the tritium vials 32, 32' from impact, chemicals, water, or other environmental conditions of the knife blade assembly 20 which could otherwise damage or break the tritium vials 32, 32' nested or housed therein.

As illustrated in FIG. 14, in an aspect, a protective sleeve 56 can be disposed in surrounding relationship with the tritium vials 32, 32' to provide further protection and cushioning of the vials 32, 32' within the first and second portions 22, 24 of the thumb stud 20. As further illustrated in FIG. 14, each of the first and second lenses 34 can be recessed from respective first and second ends 26, 28 of the body 21 to prevent the lenses 34 from regular contact or impact during use of the knife assembly 10, and thus avoid the transferring of such impact forces to the tritium vials 32, 32' to provide further protection of the tritium vials 32, 32' from damage or breakage during regular and everyday use of the knife assembly 10. Since the tritium vials 32, 32' are secured within the first and second portions 22, 24, the tritium thumb stud 20 can be incorporated into the knife assembly 10 simply by passing one of the first or second portions 22, 24 through the aperture 19 of the knife blade 14, and then threadingly interconnecting the other of the first or second portions 22, 24 thereto.

Figure 15:
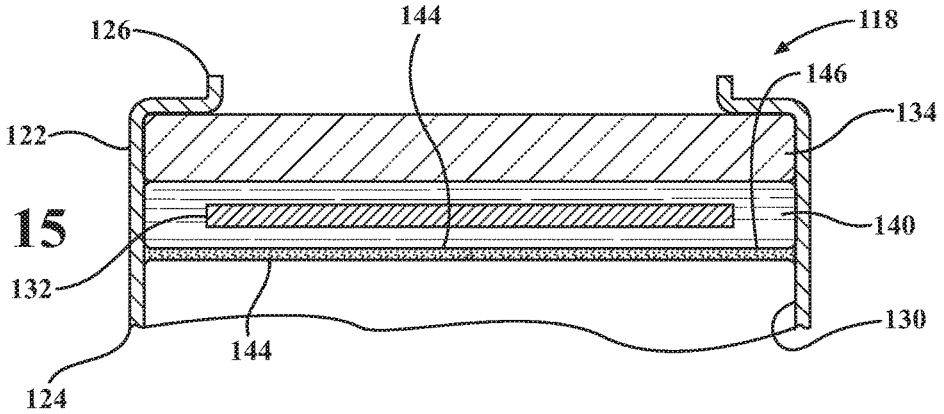
FIG. 15 is a fragmentary, cross-sectional view of a button or switch for a knife assembly illustrating a wafer encapsulating a tritium vial and disposed adjacent an outer end of a body member in sandwiched relationship between a lens and a bonding material.

As previously mentioned, the subject disclosure can also be employed in a wide range of other applications, such as with buttons or switches 18 for a knife assembly 10 or other devices and tools. In this regard, and as illustrated in FIG. 15, the buttons or switches 118 of this alternative arrangement only include a single body member 122 extending from an inner end 124 to an outer end 126 which is to be disposed about an exposed surface of the knife assembly 10 or tool. Similar to the previously described embodiments, the body member 122 of the button or switch 118 defines a hollow passage 130 which extends from the inner end 124 to the outer end 126. However, in this alternative arrangement, a tritium vial 132 is encapsulated within a single wafer or tray 140 disposed adjacent only the outer end 126 of the body member 122.

As best illustrated in FIG. 15, and similar to the second embodiment of the thumb stud 20, a lens 134 comprised of transparent or translucent material, such as glass or an injection molded plastic, is disposed adjacent the outer end 126 of the body 122. Also similar to the second embodiment of the thumb stud 20, the wafer 140 which encapsulates the tritium vial 132 is sandwiched between the lens 134 and a bonding material 144, such as glue or the like, for maintaining the wafer 140 next adjacent the outer end 126 of the body 122.

As will be appreciated from the subject disclosure, the incorporation of the tritium vial 132 into the buttons or switches 118 provides aesthetic benefits to the knife blade assembly 10 or tool by illuminating the buttons or switches 118 and allowing a user to see the buttons or switches 118 at all times. Not only does the lens 134 protect the wafer 140 and the tritium vial 132, but its transparent or translucent composition allows illumination produced by the tritium vial to be viewable by the user.

Furthermore, according to an aspect, an outside surface 146 of the bonding material 144 can be coated with or comprised of a bright or shiny surface, such as white, mirrored, glassy, or the like, to further magnify illumination produced by the tritium vial 132. Assembly of the wafer 140 into the button or switch 118 would occur in the same manner as described in conjunction with the wafer 40 of the second embodiment of the thumb stud 20, albeit with only a single body 120 and a single wafer 140.

Figure 16:
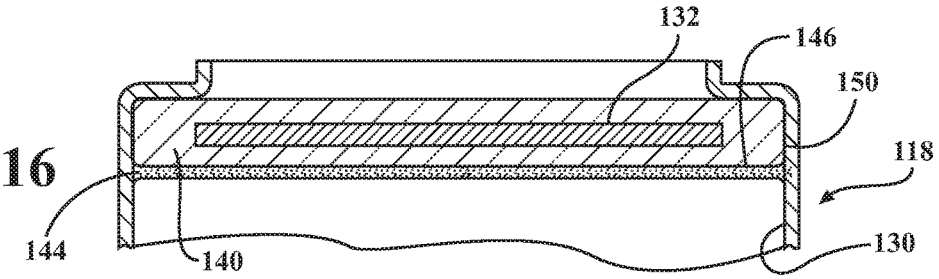
FIG. 16 is a fragmentary, cross-sectional view of the button or switch illustrating a "hockey puck" shaped member which combines the lens and tritium vial of FIG. 15 into a single element.
Figure 17:
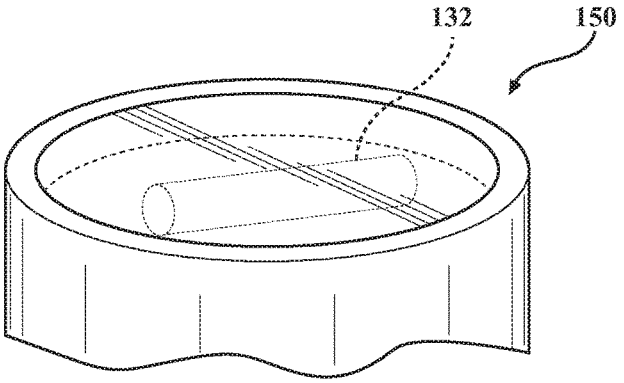
FIG. 17 is a perspective view of the "hockey puck" shaped member of FIG. 16.

As best illustrated in FIG. 16, the lens 134 and wafer 140 of FIG. 15 can be replaced with a single "hockey puck" shaped member 150 which incorporates the lens 134 and tritium vial 132 into a single element. Accordingly, use of the "hockey puck" shaped member 150 leads to a reduction in parts, and thus potentially a reduction in cost, over other embodiments of a button or switch 120 which may utilize both the lens 134 and wafer 142 to incorporate tritium. Similar to FIG. 15, the "hockey puck" shaped member 150 is disposed within a hollow passage 130 of the body 122 and secured in place by a bonding material 144.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A thumb stud for a folding knife assembly comprising:

a body extending between a first end and a second end and defining a hollow passage extending between said ends;

a vial of tritium disposed with said hollow passage and extending between said first and second ends;

a first lens disposed within said hollow passage adjacent said first end and a second lens disposed within said hollow passage adjacent said second end to encapsulate said tritium vial within said hollow passage of said body and allow illumination produced by said tritium vial to be viewable through said first and second lenses to illuminate the thumb stud;

said first and second ends of said body each defining a shoulder, and said first and second lenses each defining a flange portion disposed in abutting relationship with said shoulder to secure said tritium vial within said hollow passage between said first and second ends of said body.

2. A thumb stud as set forth in claim 1, wherein said first and second lens each include a geometrically shaped portion extending from said flange portion to magnify the illumination produced by said tritium vial.

3. A thumb stud as set forth in claim 2, wherein said geometrically shaped portions of said first and second lens each project out of said first and second ends of said body to allow the illumination produced by said tritium vial to be viewable by a user from multiple angles relative to the thumb stud.

4. A thumb stud as set forth in claim 2, wherein said geometrically shaped portions are disposed flush with said first and second ends of said body.

5. A thumb stud as set forth in claim 2, wherein said geometrically shaped portions of said first and second lenses are each dome shaped.

6. A thumb stud as set forth in claim 2, wherein said geometrically shaped portions of said first and second lenses are each rectangular shaped.

7. A thumb stud as set forth in claim 1, wherein said body includes a first portion and a second portion threadingly interconnected to one another.

8. A thumb stud as set forth in claim 1, further comprising a protective sleeve disposed in surrounding relationship with said tritium vial to protect said tritium vial from heavy use and harsh conditions of the knife assembly.

9. A thumb stud for a folding knife assembly comprising:

a body extending between a first end and a second end and defining a hollow passage extending between said ends;

a first lens disposed within said hollow passage adjacent said first end and a second lens disposed within said hollow passage adjacent said second end;

a first wafer disposed within said hollow passage adjacent said first lens, said first wafer encapsulating a first vial of tritium;

a second wafer disposed within said hollow passage adjacent said second lens, said second wafer encapsulating a second vial of tritium; and a bonding material disposed within said hollow passage and in contact with said first and second glass wafers to sandwich said first and second wafers between said respective lens and said bonding material and secure said first and second wafers adjacent said respective first and second ends of said body.

10. A thumb stud as set forth in claim 9, wherein said first and second ends of said body each define a shoulder, and said first and second lenses each define a flat surface disposed in abutting relationship with said shoulder to establish said secured relationship of said first and second glass wafers within said hollow passage.

11. A thumb stud as set forth in claim 9, wherein said first and second lenses each include a geometrically shaped portion to magnify the illumination produced by said first and second tritium vials.

12. A thumb stud as set forth in claim 10, wherein said geometrically shaped portions of said first and second lens each project out of said first and second ends of said body to allow the illumination produced by said tritium vial encapsulated with said respective wafers to be viewable by a user from multiple angles relative to the thumb stud.

13. A thumb stud as set forth in claim 9, wherein said body includes a first portion and a second portion threadingly interconnected to one another, and said first lens and said first wafer are secured in said first portion by said bonding material and said second lens and said second wafer are secured in said second portion by said bonding material.

14. A thumb stud as set forth in claim 9, wherein said first and second wafers each define a cavity, and said first and second tritium vials are housed within said respective cavities to further protect said first and second tritium vials from an environment of the thumb stud.

15. A thumb stud as set forth in claim 9, wherein said bonding material includes an outside surface which faces said first or second ends and is disposed in overlaying relationship with said first and second wafers, and said outside surface is comprised of a white or mirrored material to further magnify illumination produced by said first and second tritium vial encapsulated within said respective wafers.

16. A thumb stud for a folding knife assembly, comprising:

a body having a first portion and a second portion threadingly interconnected with one another and extending between a first end and a second end;

said first portion of said body defining a first hollow passage extending from said first end;

said second portion of said body defining a second hollow passage extending from said second end;

a first vial of tritium disposed within said first hollow passage;

a first lens disposed within said first hollow passage and adjacent said first end to encapsulate said first vial of tritium within said first hollow passage of said first portion of said body and allow illumination produced by said first tritium vial to be viewable through said first lens to illuminate said first end of the thumb stud;

a second vial of tritium disposed within said second hollow passage;

a second lens disposed within said second hollow passage and adjacent said second end to encapsulate said second vial of tritium within said second hollow passage of said second portion of said body and allow illumination produced by said second tritium vial to be viewable through said second lens to illuminate said second end of the thumb stud.

17. A thumb stud as set forth in claim 15, further comprising a bonding material disposed within said first and second hollow passages and in contact with said respective first and second tritium vials to sandwich said first and second tritium vials between said respective first and lenses and said bonding material and secure said first and second tritium vials adjacent said respective first and second ends of said body.

18. A thumb stud as set forth in claim 15, wherein said first and second vials of tritium are each disposed within a protective sleeve to protect said first and second tritium vials from heavy use and harsh environmental conditions of the knife assembly.

19. A thumb stud as set forth in claim 15, wherein said first and second lens are each recessed from respective first and second ends of said body.

* * * * *